US011634847B2

(12) United States Patent
Hahn et al.

(10) Patent No.: US 11,634,847 B2
(45) Date of Patent: Apr. 25, 2023

(54) WASHING MACHINE AND METHOD OF CONTROLLING THE SAME

(71) Applicant: Samsung Electronics Co., Ltd., Suwon-si (KR)

(72) Inventors: Jeongwon Hahn, Suwon-si (KR); Jeongnam Kim, Suwon-si (KR); Kyungshin Moon, Suwon-si (KR); Byunggwon Park, Suwon-si (KR); Romon Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 49 days.

(21) Appl. No.: 17/116,122

(22) Filed: Dec. 9, 2020

(65) Prior Publication Data

US 2021/0180232 A1 Jun. 17, 2021

(30) Foreign Application Priority Data

Dec. 13, 2019 (KR) ..... 10-2019-0166734

(51) Int. Cl.
*D06F 33/32* (2020.01)
*D06F 35/00* (2006.01)
(Continued)

(52) U.S. Cl.
CPC ..... *D06F 33/32* (2020.02); *D06F 35/005* (2013.01); *D06F 33/36* (2020.02); *D06F 34/32* (2020.02); *D06F 2101/20* (2020.02)

(58) Field of Classification Search
CPC ..... D06F 33/32; D06F 35/005; D06F 35/006; D06F 2101/20
See application file for complete search history.

(56) References Cited

U.S. PATENT DOCUMENTS 10,106,924 B2 10/2018 Cruickshank et al.
2010/0287711 A1 11/2010 Geyer et al.
(Continued)

FOREIGN PATENT DOCUMENTS

CN 108866932 A 11/2018
JP H06-126075 A 5/1994
(Continued)

OTHER PUBLICATIONS

Machine translation of KR 100394001 B1, dated Aug. 2003. (Year: 2003).*

(Continued)

*Primary Examiner* — Joseph L. Perrin
*Assistant Examiner* — Kevin G Lee
(74) *Attorney, Agent, or Firm* — Staas & Halsey LLP

(57) ABSTRACT

A washing machine and a method of controlling the washing machine are provided. The washing machine includes a display configured to display a washing course and a first washing option set corresponding to the washing course, an inputter configured to receive a user's option change command for changing at least one washing option among a plurality of washing options included in the first washing option set from a user, a storage configured to store a washing option set including the changed at least one washing option, and at least one processor configured, based on the storage of the washing option set being more than a predetermined number of times, to control the first washing option set to be changed to a second washing option set based on the changed at least one washing option.

9 Claims, 13 Drawing Sheets

(51) Int. Cl.

| | |
|---|---|
| *D06F 33/36* | (2020.01) |
| *D06F 34/32* | (2020.01) |
| *D06F 101/20* | (2020.01) |

(56) References Cited

U.S. PATENT DOCUMENTS

| | | | | |
|---|---|---|---|---|
| 2016/0312396 | A1* | 10/2016 | Cruickshank | D06F 33/32 |
| 2019/0169780 | A1 | 6/2019 | Chen et al. | |

FOREIGN PATENT DOCUMENTS

| | | | |
|---|---|---|---|
| JP | 3388785 | B2 | 1/2003 |
| JP | 2011-206101 | A | 10/2011 |
| KR | 10-0394001 | B1 | 7/2002 |
| KR | 10-2005-0066442 | A | 6/2005 |
| KR | 10-0878469 | B1 | 1/2009 |
| KR | 10-2012-0028664 | | 3/2012 |
| KR | 10-1186314 | B1 | 9/2012 |
| KR | 10-2016-0135557 | | 11/2016 |
| KR | 10-2019-0104947 | A | 9/2019 |
| KR | 10-2019-0108855 | A | 9/2019 |

OTHER PUBLICATIONS

Machine translation of JP 2011-206101 A, dated Oct. 2011. (Year: 2011).*

International Search Report dated Apr. 8, 2021, issued in International Patent Application No. PCT/KR2020/017768.

European Search Report dated Dec. 15, 2022, in European Application No. 20 89 8747.

* cited by examiner

FIG. 10

| | WASHING TEMPERATURE | NUMBER OF RINSING TIMES | DEHYDRATION LEVEL |
|---|---|---|---|
| 1 | 20 | 3 | 4 |
| 2 | 20 | 4 | 4 |
| 3 | 30 | 4 | 4 |
| 4 | 30 | 4 | 5 |
| 5 | 40 | 3 | 3 |

WASHING MACHINE AND METHOD OF CONTROLLING THE SAME

CROSS-REFERENCE TO RELATED APPLICATION(S)

This application is based on and claims priority under 35 U.S.C. § 119 of a Korean patent application number 10-2019-0166734, filed on Dec. 13, 2019, in the Korean Intellectual Property Office, the disclosure of which is incorporated by reference herein in its entirety.

BACKGROUND

1. Field

The disclosure relates to a washing machine and a method of controlling the washing machine. More particularly, the disclosure relates to a technology for automatically adjusting a washing option of the washing machine.

2. Description of Related Art

In general, washing machines are devices that perform a washing process, a rinsing process, and a dehydrating process by rotating its cylindrical spinning tub that contains laundry.

Existing washing machines performed only a uniform course regardless of the type of laundry, but recently used washing machines perform washing on various types of laundry through various washing modes. For example, a user may control an operation of the washing machine through operation of a control panel provided in the washing machine, or control the washing machine to perform washing by setting a desired washing course and washing option. Here, the washing options include a washing temperature, a number of rinsing times, a dehydration level, etc.

The washing options are set by a manufacturer to perform an optimal washing course for each washing course. However, this has a limitation in satisfying the user's individual washing preference, and it is cumbersome to change the washing option every time the user uses the washing machine.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a washing option for each washing course suitable for a user's washing preference.

Additional aspects will be set forth in part in the description which follows and, in part, will be apparent from the description, or may be learned by practice of the presented embodiments.

In accordance with an aspect of the disclosure, a washing machine is provided. The washing machine includes a display configured to display a washing course and a first washing option set corresponding to the washing course, an inputter configured to receive a user's option change command for changing at least one washing option among a plurality of washing options included in the first washing option set from a user, a storage configured to store a washing option set including the changed at least one washing option, and at least one processor configured, based on the storage of the washing option set being more than a predetermined number of times, to control the first washing option set to be changed to a second washing option set based on the changed at least one washing option.

Based on the user's selection of a washing course, the at least one processor may be further configured to display the second washing option set corresponding to a washing course selection on the display.

In response to an operation of the washing machine being started based on the changed at least one washing option, the at least one processor may further be configured to control the storage to store the changed at least one washing option.

In response to an operation of the washing machine being completed based on the changed at least one washing option, the at least one processor may further be configured to control the storage to store the changed at least one washing option.

Based on the storage of the changed at least one washing option being continuous and more than the predetermined number of times, the at least one processor may further be configured to control the first washing option set corresponding to the washing course to be changed to the second washing option set based on the changed at least one washing option.

Based on a user's option change input for any one washing option of the first washing option set is less than the predetermined number of times, the at least one processor may further be configured to control to be displayed any one washing option of the second washing option set as an unchanged washing option.

The first washing option set may include a first washing option, a second washing option, and a third washing option.

Based on a plurality of first washing options, a plurality of second washing options, and a plurality of third washing options being stored in the storage by a plurality of option change inputs of the user, the at least one processor may further be configured to control to change to the second washing option set based on a washing option continuously being inputted more than the predetermined number of times in each of the plurality of first washing options, the plurality of second washing options, and the plurality of third washing options.

The display may be configured to display a first operating time based on a weight of a laundry. The at least one processor may further be configured to control to change to a second operating time based on the change to the second washing option set from the first operating time.

The washing machine may further include a transceiver configured to perform communication with an external terminal. The at least one processor may further be configured to control the second washing option set to be displayed on the external terminal based on a user's option change input being received from the external terminal.

In accordance with another aspect of the disclosure, a method of controlling a washing machine is provided. The method includes displaying, by a display, a washing course and a first washing option set corresponding to the washing course, receiving, by an inputter, a user's option change command for changing at least one washing option among a plurality of washing options included in the first washing option set from a user, storing, by a storage, a washing option set including the changed at least one washing option, and based on the storage of the washing option set being more than a predetermined number of times, controlling, by at least one processor, the first washing option set to be changed to a second washing option set based on the changed at least one washing option.

The method may further include, based on a user's selection of the washing course, displaying, by the at least one processor, the second washing option set corresponding to the washing course selection on the display.

The storing of the second washing option set may include, in response to an operation of the washing machine being started based on the changed at least one washing option, storing, by the storage, the changed at least one washing option.

The storing of the second washing option set may include, in response to an operation of the washing machine being completed based on the changed at least one washing option, storing, by the storage, the changed at least one washing option.

The controlling of the first washing option set to be changed to the second washing option set may include, based on the storage of the changed at least one washing option being continuous and more than the predetermined number of times, controlling the first washing option set corresponding to the washing course to be changed to the second washing option set based on the changed at least one washing option.

The controlling of the first washing option set to be changed to the second washing option set may include, based on a user's option change input for any one washing option of the first washing option set being less than the predetermined number of times, controlling to be displayed any one washing option of the second washing option set as an unchanged washing option.

The first washing option set may include a first washing option, a second washing option, and a third washing option.

The controlling of the first washing option set to be changed to the second washing option set may include, based on a plurality of first washing options, a plurality of second washing options, and a plurality of third washing options being stored in the storage by a plurality of option change inputs of a user, controlling to change to the second washing option set based on a washing option continuously being inputted more than the predetermined number of times in each of the plurality of first washing options, the plurality of second washing options, and the plurality of third washing options.

The method may further include displaying, by the display, a first operating time based on a weight of a laundry, and controlling, by the at least one processor, to change to a second operating time based on the changed second washing option set from the first operating time.

The method may further include performing, by a transceiver, communication with an external terminal, and controlling, by the at least one processor, the second washing option set to be displayed on the external terminal based on a user's option change input received from the external terminal.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 10 is a view illustrating an example of a storage table of a washing option according to an embodiment of the disclosure;

Throughout the drawings, like reference numerals will be understood to refer to like parts, components, and structures.

DETAILED DESCRIPTION

Figure 1:
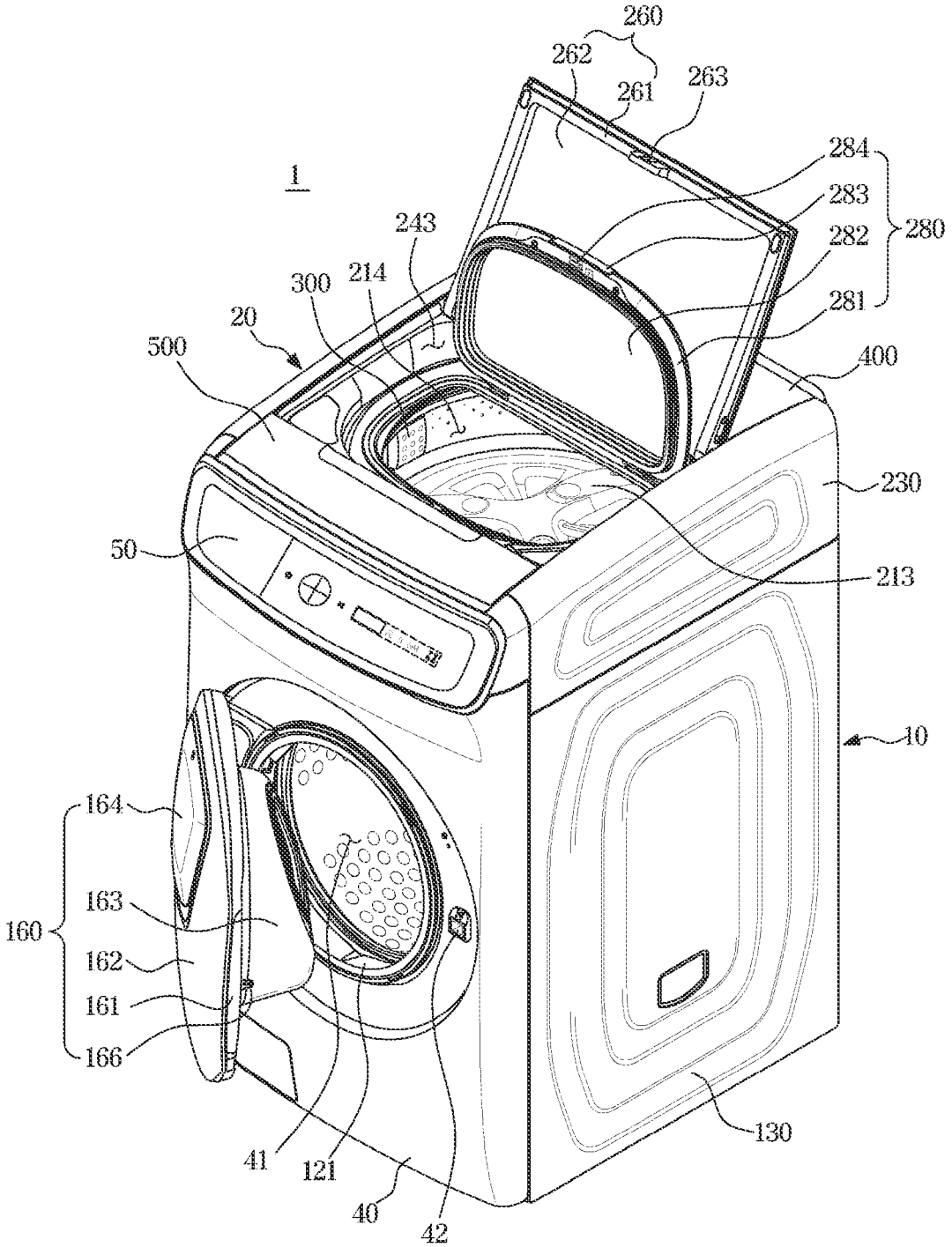
FIG. 1 is a perspective view of a washing machine according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Like reference numerals refer to like elements throughout the specification. Not all elements of the embodiments of the disclosure will be described, and the description of what are commonly known in the art or what overlap each other in the various embodiments will be omitted. The terms as used throughout the specification, such as "~ part," "~ module," "~ member," "~ block," etc., may be implemented in software and/or hardware, and a plurality of "~ parts," "~ modules," "~ members," or "~ blocks" may be implemented in a single element, or a single "~ part," "~ module," "~ member," or "~ block" may include a plurality of elements.

It will be further understood that the term "connect" and its derivatives refer both to direct and indirect connection, and the indirect connection includes a connection over a wireless communication network.

The terms "include (or including)" and "comprise (or comprising)" are inclusive or open-ended and do not exclude additional, unrecited elements or method operations, unless otherwise mentioned. It will be further understood that the term "member" and its derivatives refer both to when a member is in contact with another member and when another member exists between the two members.

Further, when it is stated that a layer is "on" another layer or substrate, the layer may be directly on another layer or substrate or a third layer may be disposed therebetween.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

It is to be understood that the singular forms "a," "an," and "the" include plural references unless the context clearly dictates otherwise.

Reference numerals used for method operations are merely used for convenience of explanation, but not to limit an order of the operations. Thus, unless the context clearly dictates otherwise, the written order may be practiced otherwise.

Hereinafter, an operation principle and embodiments of the disclosure will be described with reference to accompanying drawings.

Figure 2:
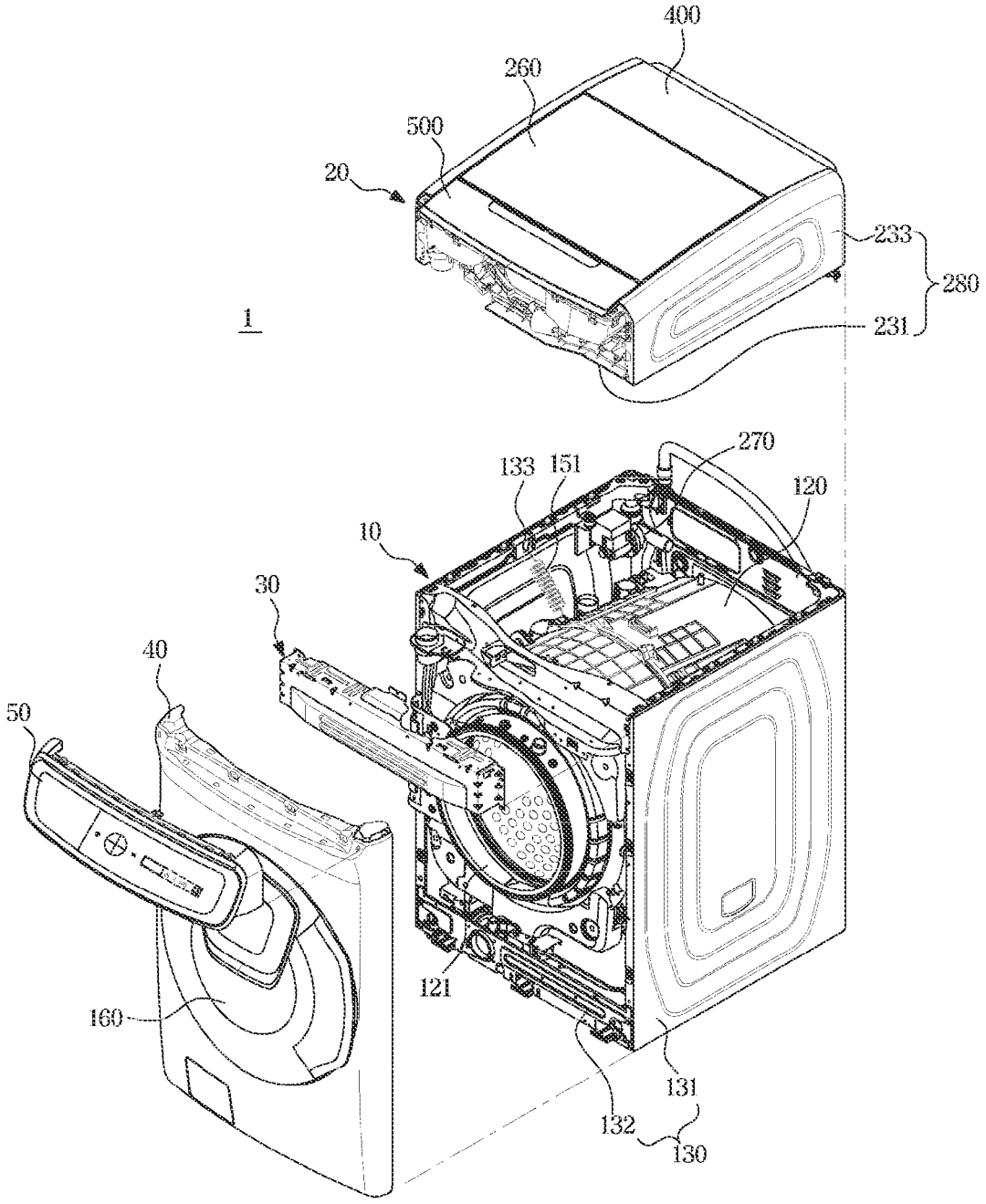
FIG. 2 is a view illustrating the washing machine illustrated in FIG. 1 by separating according to an embodiment of the disclosure.
Figure 3:
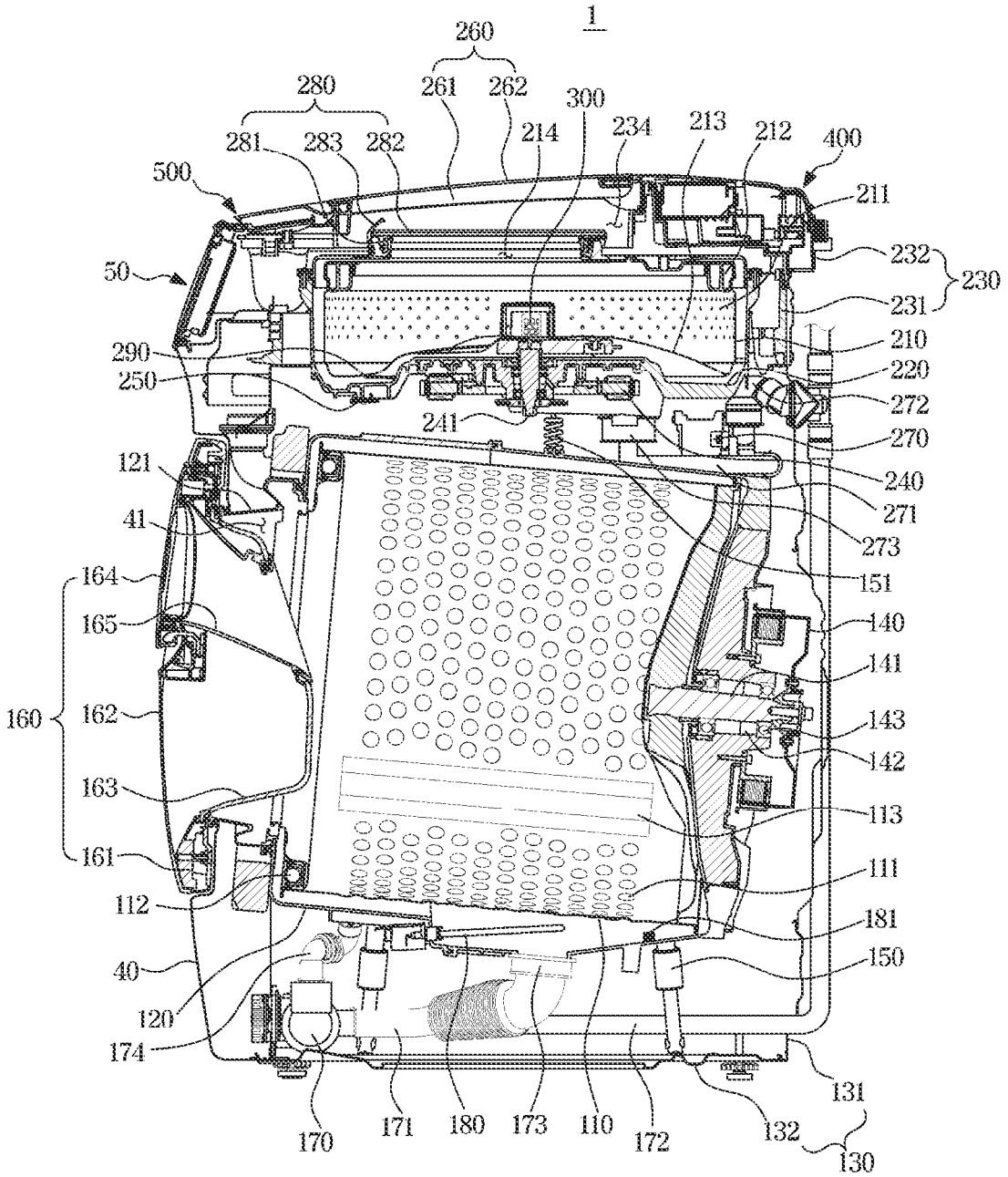
FIG. 3 is a cross-sectional view of the washing machine illustrated in FIG. 1 according to an embodiment of the disclosure.

FIG. 1 is a perspective view of a washing machine according to an embodiment of the disclosure, FIG. 2 is a view illustrating the washing machine illustrated in FIG. 1 with a first washing device and a second washing device separated according to an embodiment of the disclosure, and FIG. 3 is a cross-sectional view of the washing machine illustrated in FIG. 1 according to an embodiment of the disclosure.

A washing machine 1 disclosed in FIGS. 1 to 3 is a washing machine 1 of a type in which a washing machine and a method of controlling the same according to the disclosed embodiment are implemented. There are no restrictions on the types and shapes of washing machines to which the technical features of the disclosure are applied.

Referring to FIGS. 1 to 3, the washing machine 1 may include a first washing device 10 of a front-loading type with a laundry inlet formed on the front, and a second washing device 20 of a top-loading type with a laundry inlet formed on the top. The second washing device 20 may be installed above the first washing device 10.

The first washing device 10 may include a first drum 110 in which a first washing space is formed and a first tub 120 containing the first drum 110 and storing water for washing or rinsing to be used in a washing process or a rinsing process. The first drum 110 and the first tub 120 may be shaped like a cylinder with at least a portion of a side opened, and the open portion may be positioned almost toward the front.

The first washing device 10 may include a first housing 130. The first housing 130 may include a side frame 131 forming an appearance of side and rear surfaces and a bottom frame 132 forming a bottom surface.

The first washing device 10 may also include a damper 150 and a spring 151 for supporting the first tub 120 with respect to the first housing 130. The damper 150 may support the first tub 120 from a lower side by connecting an outer surface of the first tub 120 and the bottom frame 132. The spring 151 may support the first tub 120 from an upper side by connecting an outer surface of the first tub 120 and a spring coupling portion 133 provided on the upper side of the side frame 131. The damper 150 and the spring 151 may mitigate vibration, noise, and shock caused by the flow of the first tub 120.

An installation position of the damper 150 and the spring 151 is not limited to the upper end of the side frame 131 and the bottom frame 132, and if necessary, one surface of the first tub 120 and a portion of the first housing 130 may be connected to support the first tub 120.

The first washing device 10 may include a first driving motor 140 arranged behind the first tub 120 to rotate the first drum 110. A first driving shaft 141 may be provided on the rear side of the first drum 110 for transferring power from the first driving motor 140. A plurality of first through holes 111 may be formed along the circumference of the first drum 110 for water circulation. On the inner circumference of the first drum 110, a plurality of lifters 113 may be provided to enable the laundry to be moved up and down while the first drum 110 is rotating. A first balancer 112 may be equipped on a front portion of the first drum 110 to help the first drum 110 stably spin at high speed.

The first driving shaft 141 may be arranged between the first drum 110 and the first driving motor 140. The first driving shaft 141 may be coupled to the back plate of the first drum 110 at one end, may pass through the back wall of the first tub 120, extend to the outside of the back wall of the first tub 120, and may be coupled to the first driving motor 140 at the other end. When the first driving motor 140 rotates the first driving shaft 141, the first drum 110 coupled to the first driving shaft 141 is rotated around the first driving shaft 141.

The rear wall of the first tub 120 may be arranged with a bearing housing 142 for rotatably supporting the first driving shaft 141. The bearing housing 142 may be made of an aluminum alloy and may be inserted into the rear wall of the first tub 120 when the first tub 120 is injection molded. Bearings may be arranged between the bearing housing 142 and the first driving shaft 141 so that the first driving shaft 141 rotates smoothly.

The first washing device 10 may do the laundry with hot water. To obtain hot water, a first heater 180 may be provided on the bottom of the first tub 120 to heat the water stored in the first tub 120. The first washing device 10 may further include a temperature sensor 181 for detecting the temperature of the water contained in the first tub 120.

The first washing device 10 may include a first drain pump 170 arranged in a lower portion of the first tub 120 for draining the water out of the washing machine 1 from inside the first tub 120, a first coupling hose 171 coupling a first drain 173 of the first tub 120 and the first drain pump 170 for allowing the water inside the first tub 120 to flow into the first drain pump 170, a circulation hose 174 coupling the first drain pump 170 and the first tub 120 for circulating the water flowing into the first drain pump 170 to the first tub 120, and a first drain hose 172 for guiding the water pumped by the first drain pump 170 to the outside of the washing machine 1.

The washing machine 1 may include a front cover 40 with a first inlet 41 through which laundry (e.g., clothes) may be thrown into the first washing space of the first washing device 10. A first door 160 may be arranged on the front cover 40 for opening or closing the first inlet 41.

The first door 160 may be arranged to correspond to the first inlet 41 and to be able to pivot on the front cover 40. The first door 160 may include a first door frame 161, a first door cover 162, and a door glass 163.

The embodiment of the disclosure illustrates the first door frame 161 in a substantially annular shape, the disclosure is not limited thereto, and the first door frame 161 may be made of a substantially rectangular shape. The first door cover 162 and the door glass 163 may be made of a transparent material so that the inside of the first drum 110 can be seen from the outside of the washing machine 1 even when the first door 160 closes the first inlet 41. The door glass 163 may be formed to protrude convexly from the first door frame 62 toward the inside of the first drum 110. When the first door 160 is closed by the convexly protruding shape toward the inside of the first drum 110, the door glass 163 may be inserted into the first inlet 41.

The first door 160 may be arranged with a first hinge coupler on one side of the first door frame 161 so as to be rotatable with respect to the front cover 40, and the first hinge coupler may be coupled to a first hinge arranged near the first inlet 41. A first hook 166 may be arranged on the other side of the first door frame 161, and a first hook container 42 may be arranged on the front cover 40 in correspondence with the first hook 166. When the first door 160 is closed, the first hook 166 may be inserted into the first hook container 42 so that the first door 160 can be remained closed.

The first door 160 may have an auxiliary laundry inlet through which to throw clothes into the first washing space while the first door 160 is closed, and an auxiliary door 164 to open or close the auxiliary laundry inlet. The auxiliary door 164 may be rotatably mounted to the first door cover 162.

A glass through hole may be formed in the door glass 163 through the door glass 163 such that the laundry is introduced into the washing machine 1 through the auxiliary laundry inlet 64 of the first door 160. Alternatively, an upper portion of the door glass 163 may be recessed so that the door glass 163 is not disposed behind the upper portion of the auxiliary laundry inlet.

A connection guide 165 may be formed in the first door 160 to connect the auxiliary laundry inlet 64 of the first door 160 and the glass through hole 66 of the door glass 163. The connecting guide 67 may be open at both ends and may be formed in a tubular shape having a hollow.

Particularly, one end of the connection guide 165 may be connected to the auxiliary laundry inlet, the other end of the connection guide 165 may be connected to the glass through hole. The connection guide 165 may be arranged to be inclined downward from the front to the rear. In other words, one end of the connection guide 165 connected to the auxiliary laundry inlet may be formed at a position higher than the other end connected to the glass through hole. Due to the auxiliary laundry inlet 64 and the connection guide 165, the user may be able to easily throw the laundry into the first drum 110 through the auxiliary laundry inlet 64.

An embodiment where the auxiliary door 164 is equipped on the first door 160 has thus far been described, but it is not limited thereto. For example, the auxiliary laundry inlet the auxiliary door 164, and the connection guide 165 may not be provided in the first door 160.

The first washing device 10 may include a diaphragm 68 disposed between the first inlet 41 of the front cover 40 and an opening of the first tub 120. The diaphragm 68 may form a passage from the first inlet 41 to the opening of the first tub 120. The diaphragm 68 may reduce the vibration transmitted to the front cover 40 when the first drum 110 rotates. In addition, the diaphragm 68 may be disposed between the first door 160 and the front cover 40 to prevent a wash water of the first tub 120 from leaking to the outside of the washing machine 1.

The second washing device 20 may include a second drum 210 in which a second washing space is formed and a second tub 220 containing the second drum 210 and storing water to be used in the washing process or the rinsing process. The second drum 210 and the second tub 220 may be shaped like a cylinder with at least a portion of a side open, and the open portion may be positioned almost toward the top.

The second washing device 20 may include a second housing 230. Particularly, the second housing 230 may include a lower frame 231 on which the second tub 220 is supported and an upper frame 232 arranged at the upper portion of the lower frame 231 and forming the second inlet 234 for injecting the laundry into the second washing space 22. The second inlet 234 may be formed to correspond to a second opening 26 of the second tub 220. In addition, the second housing 230 may include a side cover 233 that forms the appearance of the left side and the right side.

The second washing device 20 may include a second door 260 to open or close the second inlet 234. The second door 260 may be arranged to correspond to the second inlet 234 and to be able to pivot on the housing 35. The second door 260 may include a second door frame 261 and a second door cover 262. The second door cover 262 may be formed with a transparent material allowing the inside of the second washing space and the content in the second washing space to be seen from outside of the washing machine 1 while the second door 260 closes the second inlet 234.

A second hinge may be arranged on both left and right sides of the second door frame 261 so that the second door 260 may rotate with respect to the upper frame 232. The second hinge may be coupled to a second hinge coupler formed around the second inlet 234. A latch hole 263 may be arranged at a front end of the second door frame 261, and a latch device may be arranged at the upper frame 232 to correspond to the latch hole 263 of the second door frame 261. When the second door 260 is closed, the latch device may be inserted into the latch hole 263 so that the second door 260 can be remained closed.

The second drum 210 may have a cylindrical form with the open top and may be arranged to be able to rotate within the second tub 220. A lot of second through holes 211 may be formed in the side of the second drum 210 for water circulation. A second balancer 212 may be equipped on an upper portion of the second drum 210 to help the second drum 210 stably spin at high speed. A filter 300 provided to filter out foreign substances that may occur during washing may be attached to the inner surface of the second drum 210.

There may be a curved portion 213 formed on the bottom of the second drum 210 for creating water streams. Furthermore, a pulsator may be formed on the bottom of the second drum 210 to create water streams.

The second tub 220 may form a cylindrical shape and may be supported by the lower frame 231 through a suspension device 250. Particularly, the second tub 220 may be suspended from the lower frame 231 through four suspension devices 250.

A third inlet 214 may be provided on the upper surface of the second tub 220 to correspond to the second inlet 234, and a third door 280 for opening and closing the third inlet 214 may be coupled.

The third door 280 may include a third door frame 281 and a third door cover 282. The third door cover 282 may be formed of a transparent material so that the inside of the second drum 210 can be seen from the outside of the second tub 220 even when the third door 280 is closed with the third inlet 214.

A third hinge may be provided around the third inlet 214 so that the third door 280 can rotate with respect to the second tub 220, and is coupled to a third hinge coupler formed on one side of the third door frame 281. A handle 283 capable of opening the third door 280 may be provided on the other side of the third door frame 281, and a second hook 284 may be provided on the handle 283. A second hook container may be provided in the second tub 220 in response to the second hook 284 so that the third door 280 can be maintained in a closed state of the third inlet 214. When the handle 283 is pulled, the second hook 284 is detached from the second hook container to open the third door 280.

The second washing device 20 may include a second driving motor 240 arranged under the outside of the second tub 220 to rotate the second drum 210. A second driving shaft 241 may be provided on the bottom side of the second drum 210 for transferring power from the second driving motor 240. The second driving shaft 241 may be coupled to the bottom side of the second drum 210 at one end, may pass through the lower wall of the second tub 220, extend to the outside of the lower wall of the second tub 220, and may be coupled to the second driving motor 240 at the other end. When the second driving motor 240 rotates the second driving shaft 241, the second drum 210 coupled to the second driving shaft 241 may be rotated around the second driving shaft 241.

When the pulsator is arranged on the bottom of the second drum 210 in some embodiments, the second washing device 20 may further include a clutch device to transfer the driving force generated by the second driving motor 240 to the second drum 210 and the pulsator simultaneously or selectively.

The second washing device 20 may do the laundry with hot water. To obtain hot water, a second heater 290 may be provided on the bottom of the second tub 220 to heat the water stored in the second tub 220. The second washing device 20 may further include a temperature sensor for detecting the temperature of the water contained in the second tub 220.

The second washing device 20 may include a second drain pump 270 to drain water inside the second tub 220 out of the washing machine 1, and the second drain pump 270 may be fixed on the top of the first housing 130 of the first washing device 10. The second washing device 20 may further include a second drain hose 272 to guide the water pumped by the second drain pump 270 to the outside of the washing machine 1.

A second drain 273 is formed on the bottom of the second tub 220 to drain water out of the second tub 220, and a second coupling hose 271 is provided between the second drain 273 and the second drain pump 270 to guide the water of the second tub 220 to the second drain pump 270.

The washing machine 1 may include a water supplier 400 for supplying water to the first tub 120 of the first washing device 10 and the second tub 220 of the second washing device 20. The water supplier 400 may be disposed in the second housing 230. Particularly, the water supplier 400 may be disposed on the upper frame 232, and preferably may be disposed behind the second inlet 234.

In addition, the second washing device 20 may include a detergent supplier 500 capable of supplying detergent to the first washing device 10. The detergent supplier 500 may be disposed in the second housing 230. Particularly, the detergent supplier 500 may be disposed in the upper frame 232, and preferably may be disposed in front of the second inlet 234.

The washing machine 1 is disposed above the front cover 40 and may include a control panel 50 for operating the first washing device 10 and the second washing device 20. The control panel 50 may include an inputter 51 for receiving an operation command of the washing machine 1 from the user and a display 52 for displaying operation information of the washing machine 1. In this case, the inputter 51 and the display 52 may be implemented as a single touch screen.

Hereinafter, for convenience of description, it is assumed that the control panel 50 is implemented as a touch screen.

Figure 4:
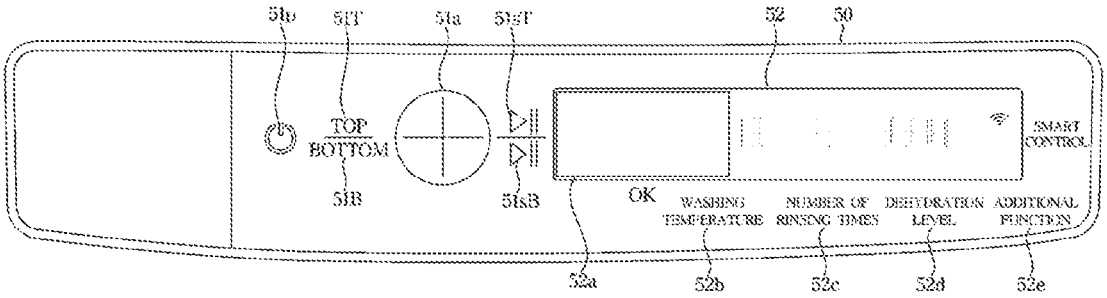
FIG. 4 is a view illustrating a control panel according to an embodiment of the disclosure.

FIG. 4 is a view illustrating a control panel according to an embodiment of the disclosure.

Referring to FIG. 4, the control panel 50 may include the inputter 51 for receiving a control command of the washing machine 1 and the display 52 for displaying the operation information and various information of the washing machine 1.

The control panel 50 may display a power icon 51*p* for controlling on/off of the power of the washing machine 1. When the power icon 51*p* is touched, the control panel 50 may receive a command to turn on the power. When command to turn on the power is input as the power icon 51*p* is touched, power may be supplied to the washing machine 1, and as a result, the control panel 50 may display various selectable objects as illustrated in FIG. 4.

The control panel 50 may be provided with an inputter 51*a* in the form of a jog dial for receiving a command for searching and selecting a washing mode of the washing machine 1.

Operation start icons 51*s*T and 51*s*B for receiving a control command for starting or stopping the washing machine 1 may be displayed on the control panel 50. In addition, the display 52 may include a display window 52*a* that displays information related to the washing mode and operation state of the washing machine 1, and may display a washing temperature icon 52*b* indicating the washing temperature, a rinsing number icon 52*c* indicating a number of rinsing times, a dehydration level icon 52*d* indicating the dehydration level, and an additional function icon 52*e* indicating an additional function of the washing machine 1.

On the control panel 50, a top washing device selection icon 51T that receives a selection command of the second washing device 20 or displays the operation state and a bottom washing device selection icon 51B that receives a selection command of the first washing device 10 or displays the operation state may be displayed. In addition, on the control panel 50, a top washing device operation start icon 51*s*T for receiving a control command for starting or stopping the operation of the second washing device 20 and a bottom washing device operation start icon 51*s*B for receiving a control command for starting or stopping the operation of the second washing device 20 may be displayed.

A washing option set corresponding to the washing mode may be displayed on the display window 52*a* of the washing machine 1. Here, the washing option set may include a first washing option indicating the washing temperature, a second washing option indicating the number of rinsing times, and a third washing option indicating the dehydration level. However, an order in which the washing option is displayed may be changed, and of course, it may be replaced or added with other additional functions in addition to the aforementioned washing option.

For example, it may be displayed on the display window 52*a* of the washing machine 1 that the washing mode is a 'standard washing' mode, the washing temperature is 30° C. as the first washing option, the number of rinsing times is 4 times as the second washing option, and the dehydration level is 5 level as the third washing option.

Figure 5:
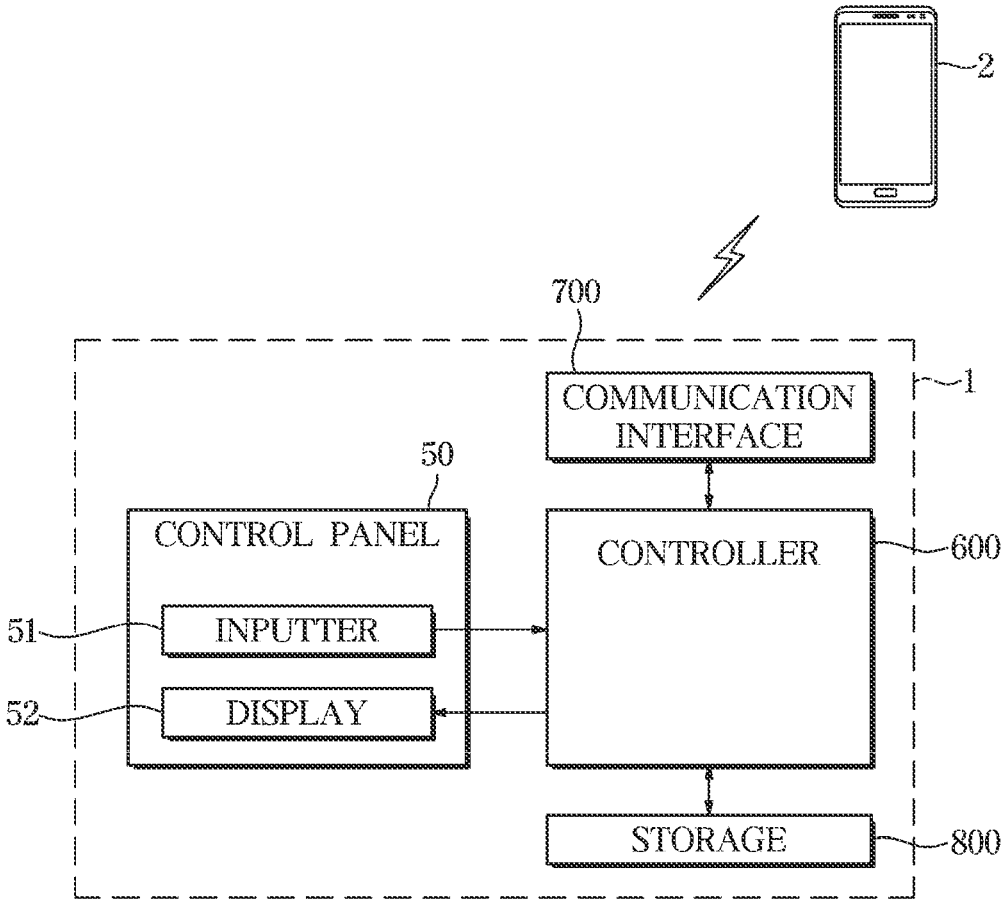
FIG. 5 is a control block diagram of a washing machine according to an embodiment of the disclosure.

FIG. 5 is a control block diagram of a washing machine according to an embodiment of the disclosure. However, this is only a preferred embodiment for achieving the aspect of the disclosure, and of course, some configurations may be added or deleted as necessary.

Referring to FIG. 5, the washing machine 1 may include the control panel 50 that performs inputs and outputs related to the operation of the washing machine 1, a controller 600 (e.g., at least one processor) that controls each component related to the operation of the washing machine 1, a communication interface 700 (e.g., a transceiver) that communicates with an external terminal 2 connected to the washing machine 1 by wire or wireless, and a storage 800 that stores data related to the operation and control of the washing machine 1.

The control panel 50 may include the inputter 51 that receives the operation command of the washing machine 1 from the user and the display 52 that displays the operation information of the washing machine 1.

The controller 600 may control the operation of the washing machine 1 and control information related to the operation of the washing machine 1 to be displayed on the display 52.

The communication interface 700 may communicate with an external terminal 2 connected to the washing machine 1 to transmit and receive operation information of the washing machine 1 and the external terminal 2. In the embodiment of the disclosure, the external terminal 2 is illustrated by taking a smart phone as an example, but there is no limitation on types and shape of the external terminal 2.

In addition, the communication interface 700 may access a server through a network to download or upload a control program or control data related to the operation of the washing machine 1 from the server.

The communication interface 700 may be implemented using a communication chip, an antenna, and related components to access at least one of a wired communication network and a wireless communication network. That is, the communication interface 700 may be implemented as various types of communication modules capable of short-range communication or long-range communication with the external terminal 2. That is, the communication interface 700 may include a wired communication module for transmitting and receiving data to and from the external terminal 2 by wire, and a wireless communication module for transmitting and receiving data wirelessly.

The storage 800 may store the control program and the control data for controlling the washing machine 1, or may store the control command input from the user. The storage 800 may include a volatile memory, e.g., a Static Random Access Memory (S-RAM) and a Dynamic Random Access Memory (D-RAM); a non-volatile memory, e.g., a flash memory, a Read Only Memory (ROM), an Erasable Programmable ROM (EPROM), and an Electrically Erasable Programmable ROM (EEPROM).

Figure 6:
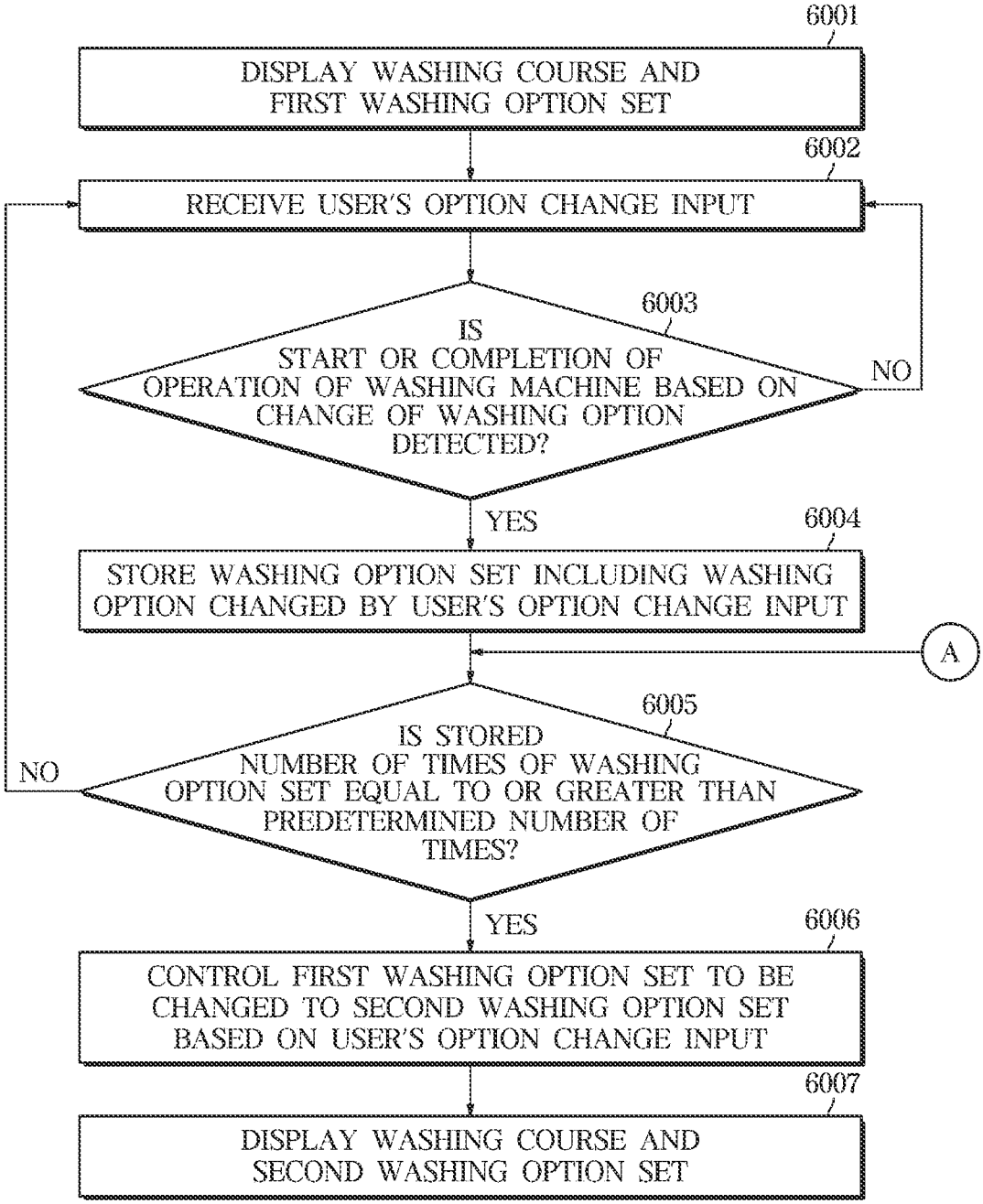
FIG. 6 is a flowchart of a method of controlling a washing machine according to an embodiment of the disclosure.
Figure 7:
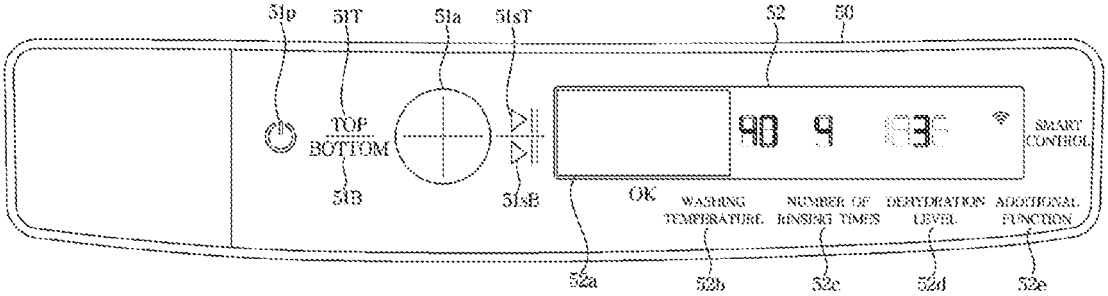
FIGS. 7 and 8 are views illustrating control panels referred to in a description of FIG. 6 according to an embodiment of the disclosure.
Figure 8:
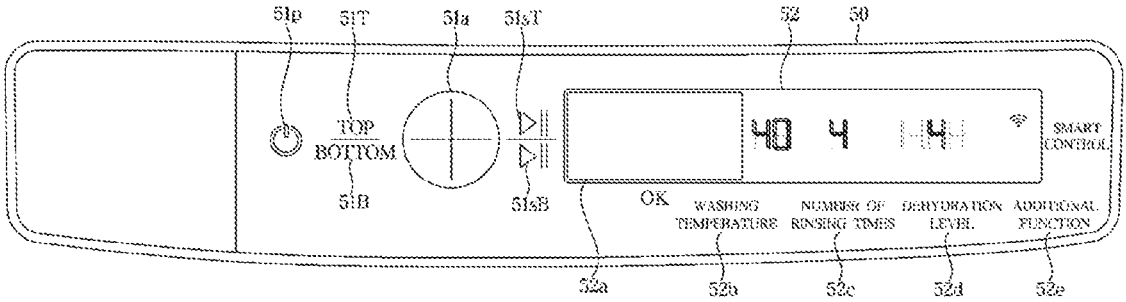

FIG. 6 is a flowchart of a method of controlling a washing machine according to an embodiment of the disclosure, and FIGS. 7 and 8 are views illustrating control panels referred to in a description of FIG. 6 according to various embodiments of the disclosure. However, this is only a preferred embodiment for achieving the aspect of the disclosure, and of course, some configurations may be added or deleted as necessary.

Referring to FIG. 6, the controller 600 may control the washing course and the first washing option set to be displayed on the display 52 at operation 6001. Particularly, the controller 600 may control the display of the first washing option set previously stored for each washing course in response to the user's selection of the washing course.

Referring to FIG. 7, on the display 52, the washing course is in the 'standard washing' mode, and as the first washing option set, the washing temperature as the first washing option is indicated as 40 degrees Celsius (° C.), the number of rinsing times as the second washing option is indicated as 4 times, and the dehydration level as the third washing option is indicated as 3 level. In the above example, the washing course has been described as an example that the washing course is standard washing, but it may be applied to other washing courses (e.g., small amount/rapid, super-strong washing, ultra-saving washing, etc.).

The controller 600 may receive a user's option change input (at operation 6002). The user may perform washing according to his or her washing preference by changing at least one washing option among the displayed first washing option sets. For example, the user may change the washing temperature from 40° C. to 50° C., or change the number of rinsing times from 4 times to 3 times to set the washing option that suits the user's washing preference.

When the user's option change input is received, the controller 600 may detect the start or completion of the operation of the washing machine 1 based on the change of the washing option (at operation 6003). When the start of the operation or the completion of the operation is detected, the controller 600 may store the washing option set including the washing option changed by the user's option change input (at operation 6004).

As described above, the storage of the washing option set may be executed under the condition that the washing machine 1 starts to operate, but may be executed under the condition that the washing machine 1 is completed. The controller 600 may store the washing option set on the condition that the operation of the washing machine 1 is completed, in case the user cancels washing while the washing machine 1 is operating.

The controller 600 may determine whether any one of the above-described conditions for storing the washing option set is satisfied and the number of times the washing option set is stored is equal to or greater than a predetermined number of times (at operation 6005).

When the number of times stored is less than the predetermined number, the controller 600 may return to operation 6002 to accumulate more data and collect the washing option set by the user's option change input.

The storage table may be analyzed to determine a washing option value that the user frequently used for each washing option among the washing option sets. The detailed analysis process will be described in detail later with reference to FIGS. 9 and 10.

The controller 600 may control the first washing option set to be changed to the second washing option set based on the user's option change input (at operation 6006). Here, the first washing option set may indicate values of washing options for each washing course that have been previously stored. The second washing option set may indicate values of newly generated washing options based on the washing option value changed several times by the user in the washing option for each washing course previously stored. Therefore, in the second washing option set, all washing option values may be changed, and at least one washing option may be changed differently from a previously set value.

When the first washing option set is changed to the second washing option set in operation 6006, the controller 600 may display the selected washing course and the second washing option set corresponding to the washing course on the display in response to the user's input of the washing course selection. Marked in (at operation 6007).

FIG. 7 illustrates the state of the control panel 50 corresponding to operation 6001 according to an embodiment of the disclosure, and FIG. 8 illustrates the state of the control panel 50 in which the changed washing option is reflected as a result of the operations 6002 to 6006 described above according to an embodiment of the disclosure. Particularly, the dehydration level of the washing option set of FIG. 7 may indicate an existing set value in 3 level, and the dehydration level in the washing option set of FIG. 8 is changed from 3 level to 4 level based on the user's option change input several times.

Additionally, the controller 600 may display an expected operating time of the washing machine 1 on the display 52 based on detecting a weight of the laundry. However, the operating time may be changed according to the changed washing option. Accordingly, the controller 600 may change and display the expected operating time based on the changed washing option. According to the embodiment, the display 52 may display a first operating time based on the weight of the laundry, and control to change to a second operating time based on a changed set of second washing options. Accordingly, the user may be provided with the operating time more accurate than the operating time considering only the weight.

Figure 9:
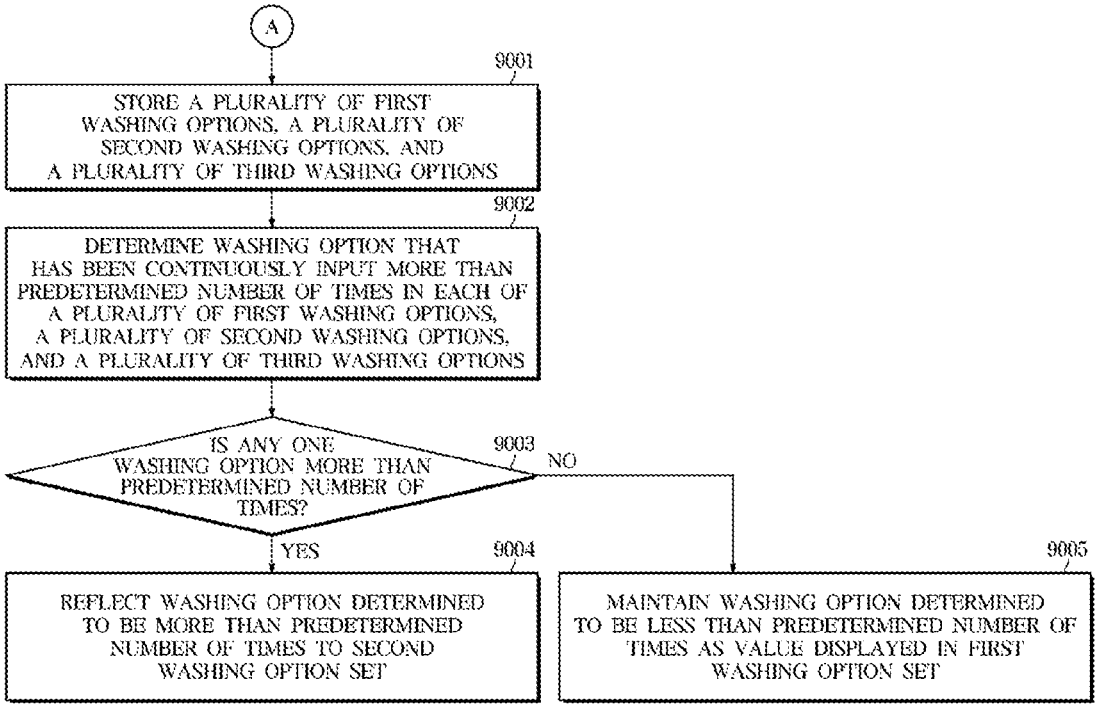
FIG. 9 is a flowchart for describing the control method of FIG. 6 in more detail according to an embodiment of the disclosure.

Referring to FIG. 9, the process of changing the condition of the washing option set will be described in more detail. FIG. 9 is a flowchart for describing the control method of FIG. 6 in more detail according to an embodiment of the disclosure, and FIG. 10 is a view illustrating an example of a storage table of a washing option according to an embodiment of the disclosure. Hereinafter, conditions of changing the washing option set will be described with reference to FIGS. 9 and 10.

In the embodiment, the first washing option may be the washing temperature, the second washing option may be the number of rinsing times, and the third washing option may be the dehydration level. However, the contents and order of the washing option are only an example. Of course, other washing options may be used, and may be stored in a different order. In addition, one washing option set may refer to a combination of a first washing option to a third washing option used by the user to start or complete the operation of the washing machine 1.

The controller 600 may store a plurality of first washing options, a plurality of second washing options, and a plurality of third washing options in the storage 800 (at operation 9001).

For example, referring to FIG. 10, the storage 800 may store the washing temperature, the number of rinsing times, and the dehydration level values over a total of 5 times. However, depending on the setting, the storage 800 may store the values of the washing option set less than or greater than 5 times.

The controller 600 may determine the washing option that has been continuously input more than the predetermined number of times in each of the plurality of first washing options, the plurality of second washing options, the plurality of third washing options (at operation 9002), and may determine whether any one washing option is more than the predetermined number of times (at operation 9003).

As a result of the determination in operation 9003, the controller 600 may reflect the washing option determined to be more than the predetermined number of times to the second washing option set (at operation 9004), and may maintain the washing option determined to be less than the predetermined number of times as the value displayed in the first washing option set (at operation 9005).

Referring to FIG. 10 again, the number of rinsing times, which is the second washing option, was stored 4 times in 3 times in a row out of 5 times. The dehydration level, which is the third washing option, was stored 4 level in 3 times in a row out of 5 times. In this case, the controller 600 may generate the second washing option set based on the washing option values stored three or more times in succession.

For example, when the number of rinsing times of the existing standard washing is set to a value other than 4 times, the controller 600 may change 4 times stored 3 times in a row. When the dehydration level is set to a value other than 4 level, the controller 600 may change to 4 level stored 3 times in a row. In contrast, the controller 600 may generate the second washing option set by maintaining the value of the previously set washing temperature for the washing temperature in which the condition is not satisfied three or more times in a row.

The controller 600 may generate the second washing option set based on a partial change of the washing option set, but unlike the above-described embodiment, the controller 600 may generate the second washing option set based on the entire washing option set. In other words, the controller 600 may generate the second washing option set based on the changed entire washing option set when the entire washing option value of the entire washing option set is common or continuously stored more than the predetermined number of times.

However, in the embodiment, a new combination of washing option sets may be generated based on individual washing option values among washing option sets. Even when changing various washing options, the second washing option set closest to the user's preference may be provided immediately.

On the other hand, the condition for changing the washing option set described above may be based on various reference in addition to storing three or more consecutive times.

According to the embodiment, the controller 600 may exclude a continuous condition and generate the second washing option set based on the value stored three or more times in the whole. However, the three or more conditions are only an example, and may be set at various times according to the manufacturer's or user's setting.

According to the embodiment, the controller 600 may generate the second washing option set based on the most stored value for each washing option. However, in this case, the following conditions may be added in case the number of times overlaps within one washing option. For example, referring to FIG. 10, the washing temperature is 20° C. and 30° C., and the most stored values are duplicated two times, and the recently stored washing temperature value is applied preferentially to generate the second washing option set.

In the above, the control method based on the user's input to the washing machine 1 has been described. Hereinafter, a control method of the washing machine 1 performed by the external terminal 2 connected to the washing machine 1 will be described with reference to FIG. 11.

Figure 11:
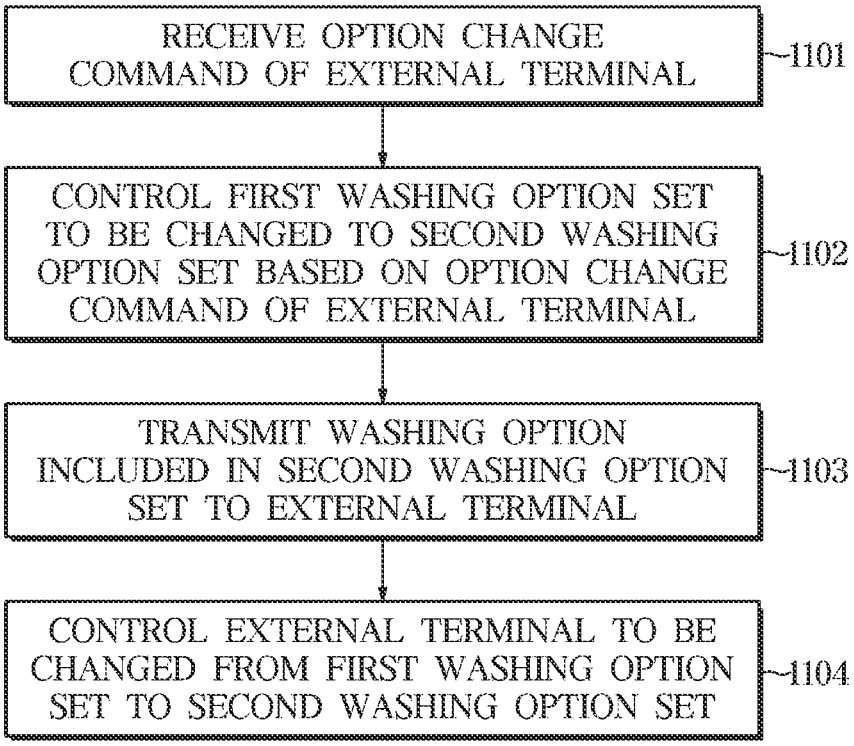
FIG. 11 is a flowchart of a method of controlling a washing machine according to an embodiment of the disclosure.

FIG. 11 is a flowchart of a method of controlling a washing machine according to an embodiment of the disclosure. However, this is only a preferred embodiment for achieving the aspect of the disclosure, and of course, some configurations may be added or deleted as necessary. Further, FIGS. 12 and 13 are views illustrating a mobile interface referenced in 11 according to various embodiment of the disclosure.

Referring to FIG. 11, the controller 600 receives an option change command of the external terminal through a communication interface that communicates with the external terminal (at operation 1101). The external terminal may be the smart phone installed with an application capable of remotely controlling the washing machine 1. However, as described above, the external terminal is not limited to the smart phone, and may be various electronic devices to which the application capable of controlling the washing machine 1 may be installed.

Figure 12:
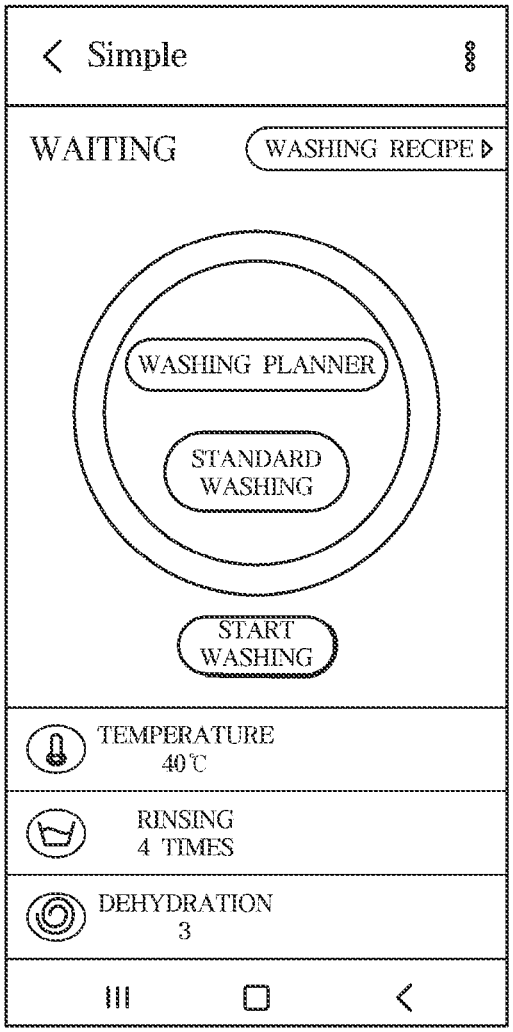
FIGS. 12 and 13 are views illustrating a mobile interface referenced in 11 according to an embodiment of the disclosure.
Figure 13:
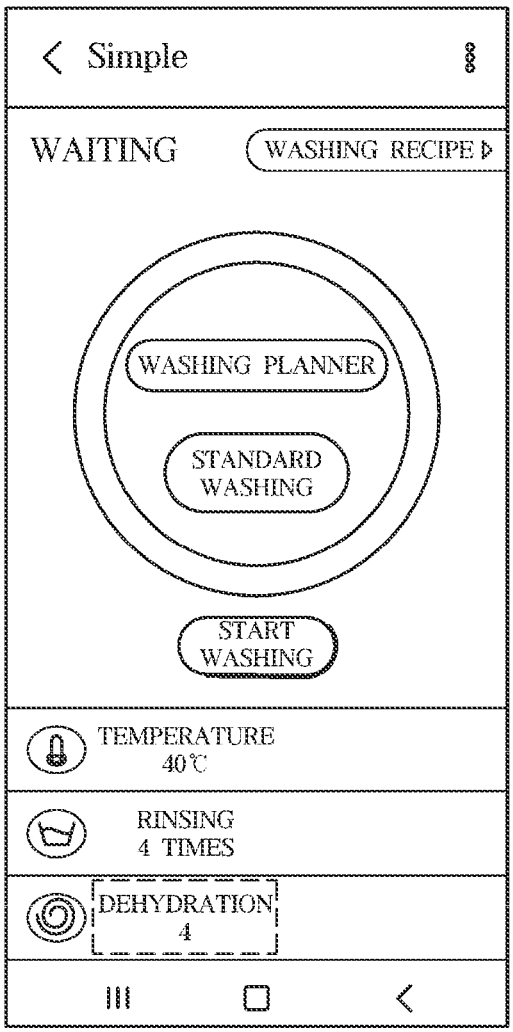

Referring to FIG. 12, the user may set the washing course through the external terminal linked to the washing machine 1, and change the washing option values of the washing temperature, the number of rinsing times, and the dehydration level corresponding to the washing course. In this case, the washing option values of the washing temperature, the number of rinsing times, and the dehydration level illustrated in FIG. 12 are previously set first washing option sets.

The controller 600 may control the first washing option set of the washing machine 1 to be changed to the second washing option set based on the option change command of the external terminal (at operation 1102). The process of generating the second washing option set may refer to the contents described in FIGS. 6 to 10.

The controller 600 may transmit the washing option included in the second washing option set to the external terminal (at operation 1103). The newly generated second washing option set may be displayed on the display 52 of the washing machine 1 or may be displayed on the external terminal linked to the washing machine 1.

When the controller 600 detects that the external terminal receives the washing option value changed by the user's option change input in operation 1103, the controller 600 may control the external terminal to be changed from the first washing option set to the second washing option set (at operation 1104).

FIG. 13 illustrates that a screen of the external terminal is changed from the first washing option set to the second washing option set according to an embodiment of the disclosure.

Referring to FIG. 13, in this case, the external terminal may immediately display the second washing option set when the user selects the washing course. When the user selects the washing course, the external terminal may display a screen that is changed from the existing first washing option set to the second washing option set. Thus, the user may identify whether the currently displayed washing option has been changed.

According to the embodiments of the disclosure, the washing option for each washing course suitable for the user's washing preference may be immediately provided, and the number of times the user operates the washing machine may be reduced.

In addition, according to the embodiments of the disclosure, even if the user is changed, it is possible to automatically provide the washing option that has been frequently used.

The disclosed embodiments may be implemented in the form of a recording medium storing computer-executable instructions that are executable by a processor. The instructions may be stored in the form of a program code, and when executed by a processor, the instructions may generate a program module to perform operations of the disclosed embodiments. The recording medium may be implemented non-transitory as a computer-readable recording medium.

The non-transitory computer-readable recording medium may include all types of recording media storing commands that can be interpreted by a computer. For example, the non-transitory computer-readable recording medium may be, for example, ROM, RAM, a magnetic tape, a magnetic disc, flash memory, an optical data storage device, and the like.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A washing machine comprising:

a display;

a communicator configured to perform communication with an external terminal through a network; and a processor configured to control the display and the communicator, wherein the processor is configured to:

in response to a washing course being selected, control the display so that a first value that is initially set for a washing option for performing the washing course is displayed, based on the first value having been changed to a second value by a user input, perform the washing course with the second value set for the washing option, determine whether the washing course with the second value set for the washing option is completed a predetermined number of times, in response to the washing course being selected after determining that the washing course with the second value set for the washing option is completed the predetermined number of times, control the display so that the second value is displayed as being set for the washing option, and control the communicator to transmit operation information related to the washing course to the external terminal.

2. The washing machine of claim 1, wherein the processor is configured to receive the second value through an inputter of the washing machine.

3. The washing machine of claim 1, wherein the processor is configured to receive the second value through the external terminal.

4. The washing machine of claim 1, wherein the processor is configured to control the display to indicate an expected operating time based on the second value.

5. The washing machine of claim 1, wherein the operation information includes a washing temperature, a number of rinsing times, and a dehydration level.

6. A washing machine comprising:

a communicator configured to perform communication with an external terminal through a network; and a processor configured to control the communicator, wherein the external terminal is configured to, in response to a washing course being selected, display a first value that is initially set for a washing option for performing the washing course, and the processor is configured to:

based on the first value having been changed to a second value by a user input to the external terminal, perform the washing course with the second value set for the washing option, determine whether the washing course with the second value set for the washing option is completed a predetermined number of times, and in response to the washing course being selected after determining that the washing course with the second value set for the washing option is completed the predetermined number of times, control the communicator so that the second value is displayed as being set for the washing option by the external terminal.

7. The washing machine of claim 6, wherein the second value is received through an inputter of the washing machine or the external terminal.

8. A washing machine comprising:

at least one memory storing instructions; and at least one processor configured to execute the instructions to:

in response to a washing course being selected, perform control so that a first value that is initially set for a washing option for performing the washing course is displayed on a display, and so that the displayed first value is changeable to a different value by a user input, based on the first value having been changed to a second value by a user input, perform the washing course with the second value set for washing option, determine whether the washing course has been selected after the washing course with the second value set for the washing option has been completed a predetermined number of times, and based on determining that the washing course has been selected after the washing course with the second value set for the washing option has been completed the predetermined number of times, maintain the second value as being initially set for the washing option for a next performance of the washing course and perform control so that the second value is displayed on the display as being initially set for the washing option for the next performance of the washing course and is changeable to a different value by a user input.

9. The washing machine of claim 8, wherein the at least one processor is configured to execute the instructions to:

based on determining that the washing course has been selected after the washing course with the second value set for the washing option has been completed less than the predetermined number of times, initially set the first value for the washing option for the next performance of the washing course and perform control so that the first value is displayed on the display as being initially set for the washing option for the next performance of the washing course and is changeable to a different value by a user input.

* * * * *